US011849852B2

(12) United States Patent
Calderon

(10) Patent No.: US 11,849,852 B2
(45) Date of Patent: Dec. 26, 2023

(54) MULTIPURPOSE PRODUCTIVITY DEVICE

(71) Applicant: Christian Calderon, Chicago, IL (US)

(72) Inventor: Christian Calderon, Chicago, IL (US)

( * ) Notice: Subject to any disclaimer, the term of this patent is extended or adjusted under 35 U.S.C. 154(b) by 51 days.

(21) Appl. No.: 17/511,605

(22) Filed: Oct. 27, 2021

(65) Prior Publication Data

US 2022/0125209 A1 Apr. 28, 2022

Related U.S. Application Data

(60) Provisional application No. 63/106,232, filed on Oct. 27, 2020.

(51) Int. Cl.
*A47C 16/00* (2006.01)
*A47C 16/04* (2006.01)
*A47C 16/02* (2006.01)

(52) U.S. Cl.
CPC ..... *A47C 16/00* (2013.01); *A47C 16/02* (2013.01); *A47C 16/04* (2013.01)

(58) Field of Classification Search
CPC ..... A47C 16/00; A47C 16/005; A47C 16/02; A47C 16/025; A47C 16/04
USPC ..... 248/118, 118.1
See application file for complete search history.

(56) References Cited

U.S. PATENT DOCUMENTS 339,807 A * 4/1886 Phillips ..... A47C 7/383 297/393
3,132,835 A * 5/1964 Drabert ..... A47C 16/025 248/397
3,531,158 A * 9/1970 Allen ..... B60N 2/787 297/411.1
4,595,234 A * 6/1986 Kjersem ..... A47C 3/029 297/451.3
4,850,069 A * 7/1989 Harper ..... A47C 16/04 5/656
5,028,024 A * 7/1991 Welles ..... A47K 17/028 248/163.1
5,356,203 A * 10/1994 Levasseur ..... A47C 16/025 297/423.46
5,921,627 A * 7/1999 Risetter ..... A01M 31/025 297/354.13
7,861,985 B2 * 1/2011 Galvin ..... F16M 11/40 455/575.1
8,016,250 B2 * 9/2011 Mead ..... A47B 21/0371 248/118.1
8,727,290 B1 * 5/2014 De La Matta ..... F16M 13/022 379/454
2002/0089227 A1 * 7/2002 Speraw ..... A47C 16/04 297/423.11
2007/0045485 A1 * 3/2007 Nichols ..... A47B 13/086 248/118
2009/0230259 A1 * 9/2009 Mead ..... F16M 11/2085 248/118

(Continued)

*Primary Examiner* — Nkeisha Smith

(57) ABSTRACT

A multipurpose productivity device may be provided comprising an elongate support member, one or more horizontal support bars and a plurality of terminal feet. The elongate support member may have a high-curvature portion and a low-curvature portion, where the low-curvature portion comprises two substantially parallel segments. The one or more horizontal support bars may couple together the two substantially parallel segments. The plurality of terminal feet may be disposed at terminal ends of the elongate support member.

19 Claims, 4 Drawing Sheets

(56) References Cited

U.S. PATENT DOCUMENTS

| | | | | |
|---|---|---|---|---|
| 2012/0091307 | A1* | 4/2012 | Haynes | A47B 23/043 248/451 |
| 2018/0133081 | A1* | 5/2018 | Kaufman | A47C 20/023 |
| 2019/0113173 | A1* | 4/2019 | Reitberger | F21V 21/32 |
| 2020/0021123 | A1* | 1/2020 | Abdul | H02J 7/0045 |
| 2021/0015019 | A1* | 1/2021 | Hughes | A47G 9/1045 |
| 2021/0037982 | A1* | 2/2021 | Schwendeman | A47G 9/1081 |

* cited by examiner

500

MULTIPURPOSE PRODUCTIVITY DEVICE

CROSS-REFERENCE TO RELATED APPLICATIONS

This application claims priority to U.S. Provisional Patent Application Ser. No. 63/106,232, entitled "Multipurpose Productivity Device," filed Oct. 27, 2020. The contents of this application are hereby incorporated by reference in their entirety.

BACKGROUND OF THE INVENTION

Nearly all industries in the marketplace are inherently underpinned by the productivity of the workers within the given industry. A greater level of productivity of workers in an industry typically produces a proportionally greater level of value associated with that industry. Therefore, there exists a need in the marketplace to maintain optimal levels of productivity of the workforce. However, productivity is often based upon several factors in a worker's life including, but not limited to, working hours, working efficiency, worker sleep, worker energy and the like.

Given such circumstances, it would be advantageous to optimize these parameters in a manner that similarly optimizes productivity. Devices designed to enhance worker productivity are numerous and ubiquitous in the marketplace. However, multipurpose productivity-enhancing devices are less common and vary in their effectiveness. Additionally, given the rising supply chain crisis, importation of many products from other countries and other states is becoming more and more expensive, difficult and time-consuming to execute. In many cases, supply chains have completely broken down and many products are no longer available at all. Therefore, multipurpose devices that at least partially minimize the number of distinct devices required to enhance the productivity of the worker are becoming more and more desirable in the industry.

The effectiveness of the given multipurpose productivity-enhancing device depends upon the issues and needs the device is solving and meeting. Common productivity issues faced by workers when working in office and at home include, but are not limited to, distractions creating attention deficits, lack of adequate sleep, lack of working equipment accessories and the like. Therefore, it would be advantageous to provide a device that substantially solves multiple of these issues and meets multiple of these needs.

Specifically, it would be advantageous to provide a multipurpose productivity device that may be manipulated into a chair configuration that enables a user to relax and improve their posture. Further, it would be advantageous to provide a multipurpose productivity device that may be manipulated into a lap desk configuration that enables a user to work on their laptop in a more comfortable working position at a location chosen by the user. Moreover, it would be advantageous to provide a multipurpose productivity device that may be manipulated into a nap station configuration that enables a user to take a nap leaning against the device at a location chosen by the user. Additionally, it would be advantageous to provide a multipurpose productivity device that is able to selective be manipulated between the chair configuration, the lap desk configuration, the nap station configuration and other improvised configurations as desired by the user.

DETAILED DESCRIPTION OF THE INVENTION

Figure 1:
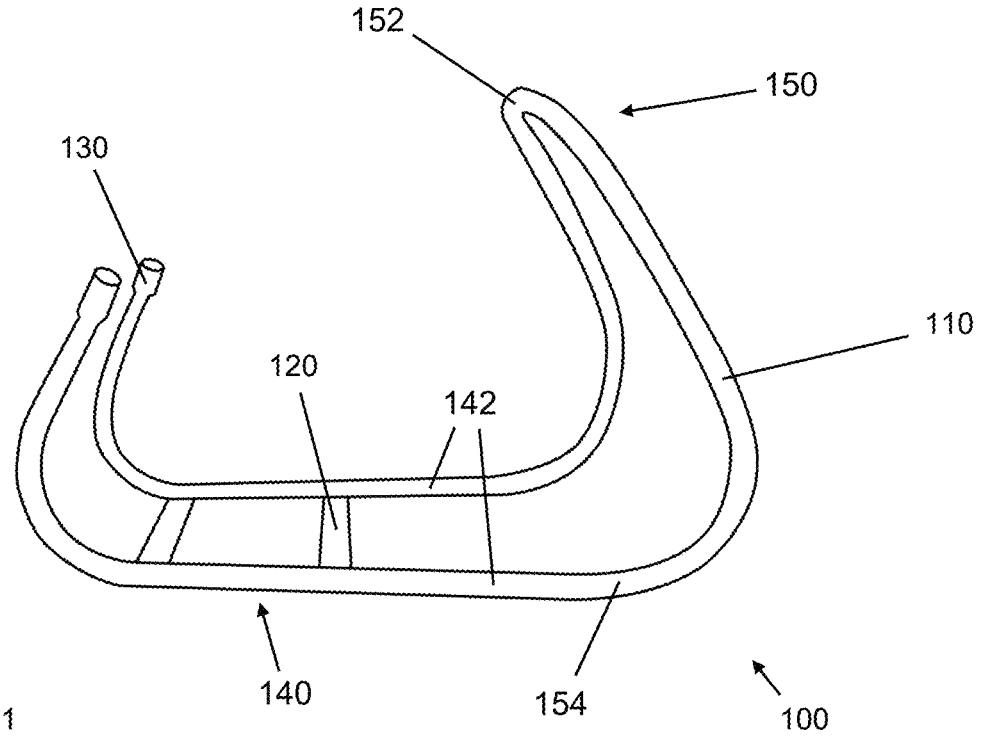
FIG. 1 illustrates a side view of a multipurpose productivity device with two horizontal support bars in an exemplary random configuration in accordance with some embodiments of the present invention.

Before describing the present invention in detail, it is to be understood that the invention is not limited to any one of the particular embodiments, which of course may vary. It is also to be understood that the terminology used herein is for the purpose of describing particular embodiments only, and therefore is not necessarily intended to be limiting. As used in this specification and the appended claims, terms in the singular and the singular forms "a," "an," and "the" include plural referents unless the context clearly dictates otherwise. Thus, for example, reference to "a multipurpose productivity device" also includes a plurality of multipurpose productivity devices and the like.

In some embodiments, a multipurpose productivity device is provided, comprising an elongate support member having a high-curvature portion and a low-curvature portion, wherein: the low-curvature portion comprises two substantially parallel segments; one or more horizontal support bars coupling together the two substantially parallel segments; and a plurality of terminal feet disposed at terminal ends of the elongate support member.

In some embodiments, the elongate support member comprises gooseneck material.

In some embodiments, the gooseneck material comprises a high-strength rigid metal material and a low-strength malleable metal material.

In some embodiments, the low-strength malleable metal material is disposed between, within or around the high-strength rigid metal material.

In some embodiments, the gooseneck material comprises a spiral structure.

In some embodiments, the exterior of the gooseneck material comprises a plurality of successive peaks and troughs along the length thereof.

In some embodiments, the high-curvature portion comprises at least a 180 degree path angle.

In some embodiments, the low-curvature portion comprises no more than a 15 degree path angle.

In some embodiments, the one or more horizontal support bars comprise gooseneck material.

In some embodiments, the one or more horizontal support bars comprise a high-strength rigid material.

In some embodiments, the one or more horizontal support bars are coupled to the two substantially parallel segments via one or more tension grips.

In some embodiments, the one or more horizontal support bars are modularly and removably coupled to the two substantially parallel segments.

In some embodiments, the plurality of terminal feet comprise a protective cap disposed thereover.

In some embodiments, the protective cap comprises foam, rubber, plastic, heat shrink wrap or any combination thereof.

In some embodiments, the elongate support member comprises a plurality of modular segments.

In some embodiments, the plurality of modular segments are modularly, removably and serially coupled together.

In some embodiments, the elongate support member comprises a chair configuration, a nap station configuration and a lap desk configuration.

In some embodiments, the elongate support member comprises a load-bearing capacity of between 5 pounds and 20 pounds.

In some embodiments, a multipurpose productivity device is provided, comprising an elongate support member having a high-curvature portion and a low-curvature portion, wherein: the low-curvature portion comprises two substantially parallel segments, the elongate support member comprises a plurality of modular segments, and the elongate support member comprises gooseneck material; one or more horizontal support bars coupling together the two substantially parallel segments, wherein: the one or more horizontal support bars comprise a high-strength rigid material; and a plurality of terminal feet disposed at terminal ends of the elongate support member.

In some embodiments, a multipurpose productivity device is provided, comprising: an elongate support member having a high-curvature portion and a low-curvature portion, wherein: the high-curvature portion comprises at least a 180 degree path angle, the low-curvature portion comprises two substantially parallel segments, the elongate support member comprises a plurality of modular segments, and the elongate support member comprises gooseneck material comprising a high-strength rigid metal material and a low-strength malleable metal material; one or more horizontal support bars coupling together the two substantially parallel segments, wherein: the one or more horizontal support bars comprise a high-strength rigid material; and a plurality of terminal feet disposed at terminal ends of the elongate support member.

Exemplary embodiments of the present invention are illustrated in the accompanying figures. As shown in FIG. 1, a side view of a multipurpose productivity device 100 with two horizontal support bars 120 in an exemplary random configuration is provided. The multipurpose productivity device 100 may comprise an elongate support member 110, one or more horizontal support bars 120 and a plurality of terminal feet 130.

The elongate support member 110 may be fabricated from a flexible yet robust gooseneck structure that allows the elongate support member 110 to be manipulated into any structurally possible shape as illustrated in the exemplary random configuration illustrated in FIG. 1. The elongate support member 110 may be utilized by a user as a main support mechanism that is structured to bear the majority of the weight being applied to the multipurpose productivity device 100.

In some embodiments, the elongate support member 110 may be manipulated into a general u-shape, where the portions of the elongate support member 110 that are adjacent each of the terminal feet 130 are coupled together via the one or more horizontal support bars 120. Further, the elongate support member 110 may comprise a plurality of modular gooseneck structure segments arranged and coupled together in a serial manner. Additionally, further modular gooseneck structure segments of the elongate support member 110 may be added or removed therefrom in a modular manner based upon the needs of the user.

In some embodiments, the elongate support member 110 may have a high-curvature portion 150 positioned between two low-curvature parallel portions 142 terminating at the terminal feet 130. The high-curvature portion may comprise at least a 180 degree path angle 152 following the path of the elongate support member 110. The low-curvature portion 140 comprises no more than a 30 degree path angle 154 following the path of the elongate support member 110.

Each of the terminal feet 130 may comprise a protective cap that covers the given terminal foot 130 and prevents debris and other contaminants from entering. The protective caps may take the form of a foam foot, a rubber foot, a plastic foot or polymer heat shrink wrap covering the terminal end of the terminal foot 130 or may take the form of a button cap that fills the cavity of the terminal end of the elongate support member 110 or any combinations thereof.

The one or more horizontal support bars 120 may be fabricated from the same flexible yet robust gooseneck structure that allows each of the one or more horizontal support bars 120 to be manipulated into any structurally possible shape. Alternatively, each of the one or more horizontal support bars 120 may be made from a rigid material that is designed to rigidly couple together each of the parallel portions of the elongate support member 110. Additionally, the one or more horizontal support bars 120 may be utilized to stabilize each terminal foot of the plurality of terminal feet 130 of the elongate support member 110.

The flexible yet robust gooseneck structure may be fabricated in a manner as known in existing gooseneck structures. Alternatively, in one embodiment, a high-strength coiled spring may be utilized that has a rigid yet malleable material embedded within an inner cavity of the high-strength coil of the spring structure. In another embodiment, a continuous spiraling band of metallic material with a malleable metallic material disposed between each successive spiral band of the continuous spiraling band.

The materials selected for the gooseneck structure may comprise a high-strength metal such as steel or similar alloys there or any like material or any combination thereof. Further, the gooseneck structure may comprise a soft malleable material which may be made from a soft galvanized iron, brass, steel or the like or any combinations thereof. Specifically, the soft malleable material of the gooseneck structure may encase (or be encased within) the high-strength metallic material to allow for manipulation of the gooseneck structure of the elongate support member 110 into the chair configuration, the lap desk configuration, the nap station configuration and any other user-improvised configuration. For instance, a user may modify the lap desk configuration to serve as a rising laptop workstation when coupled at the terminal feet 130 to an existing static desk structure. Additionally, a user may modify the nap station configuration to serve as a legs-free lap desk by simply manipulating the high-curvature u-shape portion of the elongate support substrate 110 downward into a horizontal orientation towards the user's lap area.

In order to be functional in these various configurations, the multipurpose productivity device may be fabricated to satisfy a threshold load-bearing capacity. Preferably, ranges of the load-bearing capacity may be between 3 pounds and 35 pounds and, more preferably, the load-bearing capacity may range between 5 pounds and 20 pounds. A multipurpose productivity device comprising a load-bearing capacity of at most 5 pounds would be cheaper to produce while still being robust in most user-selected structural configurations. Further, a multipurpose productivity device comprising a load-bearing capacity of at most 20 pounds would be structurally robust in nearly all user-selected structural configurations while also being more appealing to those users with a larger body mass. Values of load-bearing capacity outside of this range either would not provide the device with enough structural fidelity under average load or would be too bulky and expensive to market and profitably produce.

One or more padded cushions may be modularly and removably coupled to the elongate support member 110, the one or more horizontal support bars 120 or the plurality of terminal feet 130. The padded cushions may be structurally akin to other cushions known in the art. However, the padded cushions may be shaped to conform to the generally cylindrical shape of the elongate support member 110 and the one or more cross bar members 120. Further, the padded cushion may be made from any suitable cushioning material such as foam or the like in order to comfortably support the head or other body part of the user when in use in the chair configuration, the lap desk configuration or the nap station configuration.

While the one or more horizontal support bars 120 may restrict the flexible mobility of the elongate support member 110, such restriction is necessary in order to provide the user with a greater load-bearing capacity so that the multipurpose productivity device 100 may functionally execute the chair configuration, lap desk configuration and nap station configuration. Further, each of the one or more horizontal support bars 120 may be modularly coupled to the elongate support member 110 in any manner and at any portion along the elongate support member 110 as desired by the user.

Specifically, one or more coupling mechanisms may be utilized to modularly attach the one or more horizontal support bars 120 to the elongate support member 110. The coupling mechanisms may be implemented as tension grips which allow the user to removably attach the horizontal support bars 120 to the elongate support member 110 such that frictional gripping force stabilizes the coupling point therebetween.

Additionally, since the multipurpose productivity device 100 may be utilized in multiple settings, such as in-office and at home, a travel case may be utilized with the device 100. Specifically, the travel case may be lightweight in nature and be dimensioned to comfortably fit the form factor of the multipurpose productivity device 100 therein.

Figure 2:
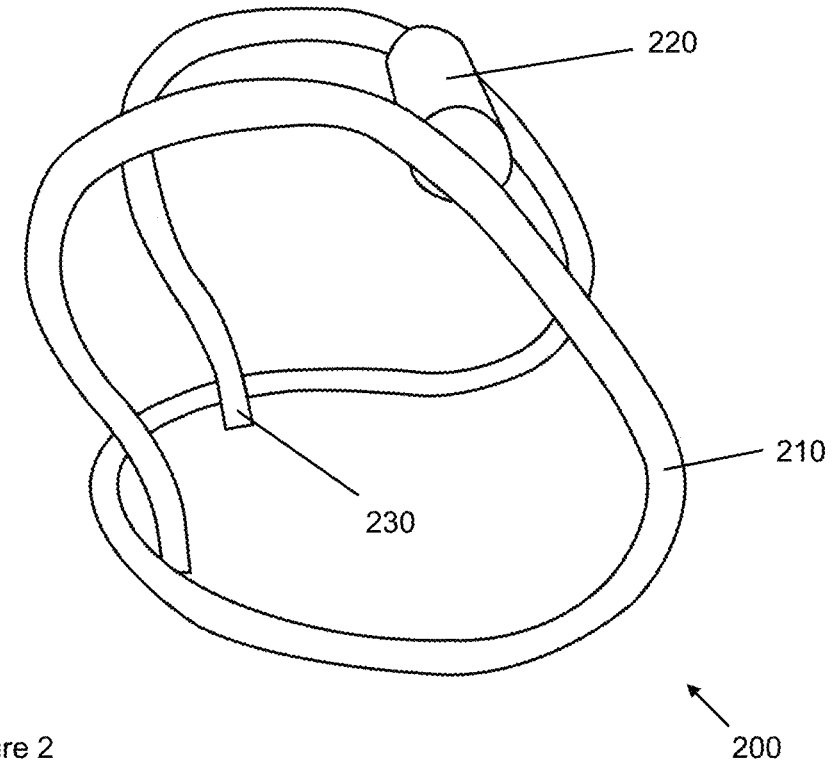
FIG. 2 illustrates a side view of a multipurpose productivity device with one horizontal support bar having a pad disposed therearound in a chair configuration in accordance with some embodiments of the present invention.

As shown in FIG. 2, a side view of a multipurpose productivity device 200 with one horizontal support bar having a pad 220 disposed therearound in a chair configuration is provided. The multipurpose productivity device 200 may comprise an elongate support member 210, the pad 220 surrounding a horizontal support bar and a plurality of terminal feet 230.

In the chair configuration, the u-shaped portion of the elongate support member 210 may be disposed around the terminal feet 230 as shown in FIG. 2. Further, the generally non-curved parallel portions of the elongate support member 210 may each be coupled to the padded horizontal support bar 220 in order to provide horizontal structural stability to the elongate support member 210 of the multipurpose productivity device 200.

Additionally, the padded cushion 220 may be disposed around the horizontal cross bar in order to provide the user with a comfortable surface upon which to rest one or more body parts, such as the user's head, back, feet and the like. The plurality of terminal feet 230 may be disposed within the u-shaped curved portion of the elongate support member 210 in order to provide added structural integrity by limiting the degree of freedom of movement of the terminal feet 230.

Figure 3:
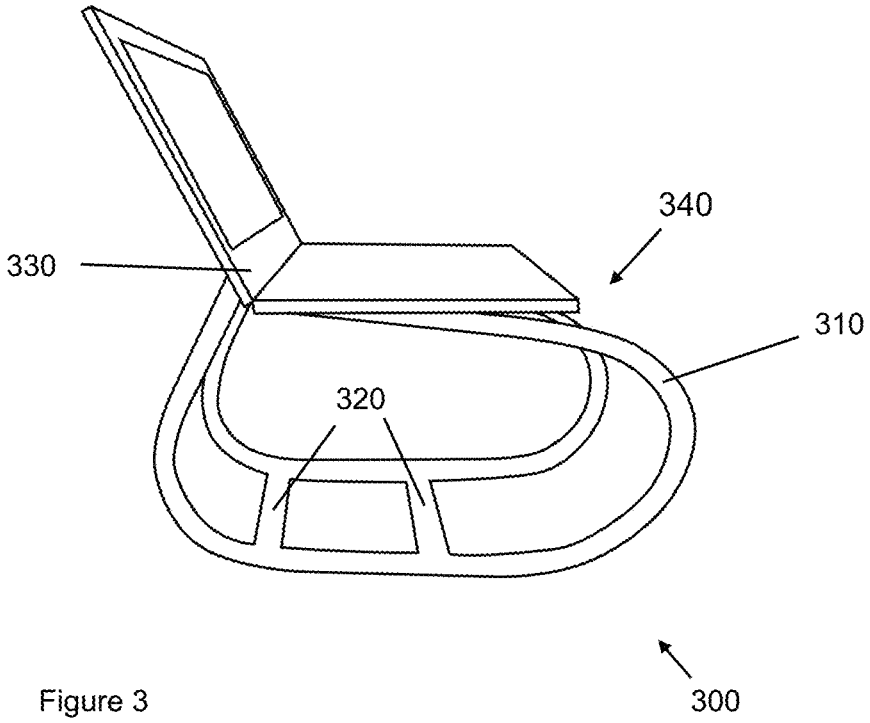
FIG. 3 illustrates a side view of a multipurpose productivity device with two horizontal support bars having in a lap desk configuration in accordance with some embodiments of the present invention.

As shown in FIG. 3, a side view of a multipurpose productivity device 300 with two horizontal support bars 320 supporting a laptop 330 in a lap desk configuration 340 is provided. The multipurpose productivity device 300 may comprise an elongate support member 310, the two horizontal support bars 320 and the laptop 330. While two horizontal support bars 320 are illustrated in FIG. 3, it is to be understood that any suitable number of horizontal support bars 320, such as one, two, three or more, may be utilized in coupling to the elongate support member 310.

In the lap desk configuration, the terminal feet may be utilized to prevent the laptop 330 from sliding backwards off of the u-shaped curved portion (not shown) of the elongate support member 310 that supports the laptop 330 from below. Additionally, the two horizontal support bars 320 may be utilized by the user as a means of stably balancing the multipurpose productivity device 300 upon the users lap such that the user can type upon the laptop 330 without having the laptop 330 move thereupon or fall off entirely. Further, the exterior of the gooseneck structure of the elongate support member 310 may comprise one or more high-friction materials that enable the laptop 330 to remain static upon the surface of the elongate support member 310.

Figure 4:
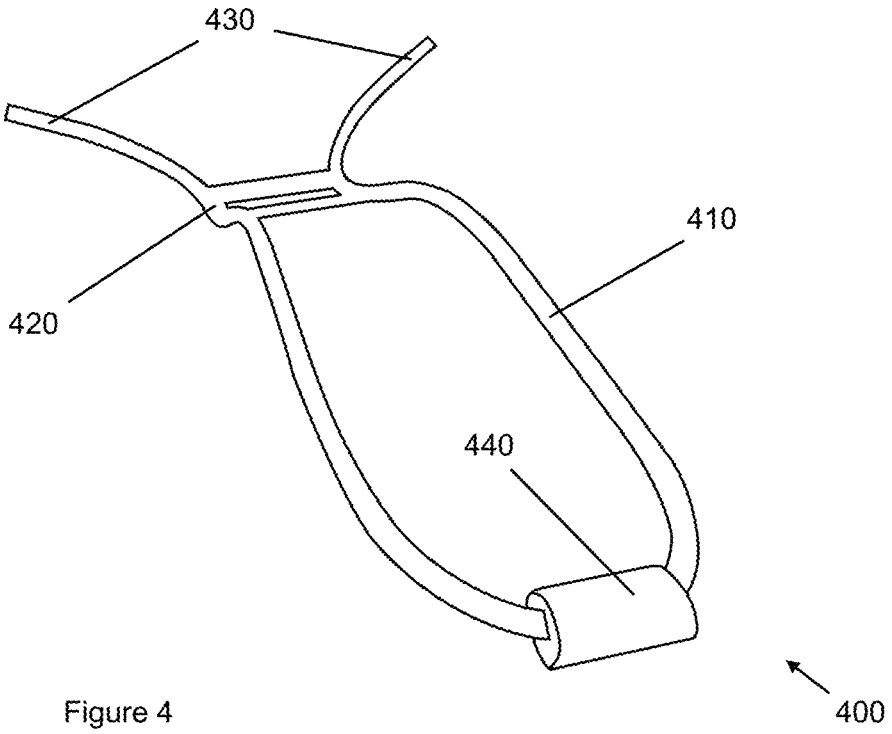
FIG. 4 illustrates a perspective view of a multipurpose productivity device with two horizontal support bars having a pad disposed around a portion of the device in a nap station configuration in accordance with some embodiments of the present invention.

As shown in FIG. 4, a perspective view of a multipurpose productivity device 400 with two horizontal support bars 420 having a pad 440 disposed around a portion of the device in a nap station configuration is provided. The multipurpose productivity device 400 may comprise an elongate support member 410, the two horizontal support bars 420, a plurality of terminal feet 430 and the padded cushion 440. While two horizontal support bars 420 are illustrated in FIG. 4, it is to be understood that any suitable number of horizontal support bars 420, such as one, two, three or more, may be utilized in coupling to the elongate support member 410.

Figure 5:
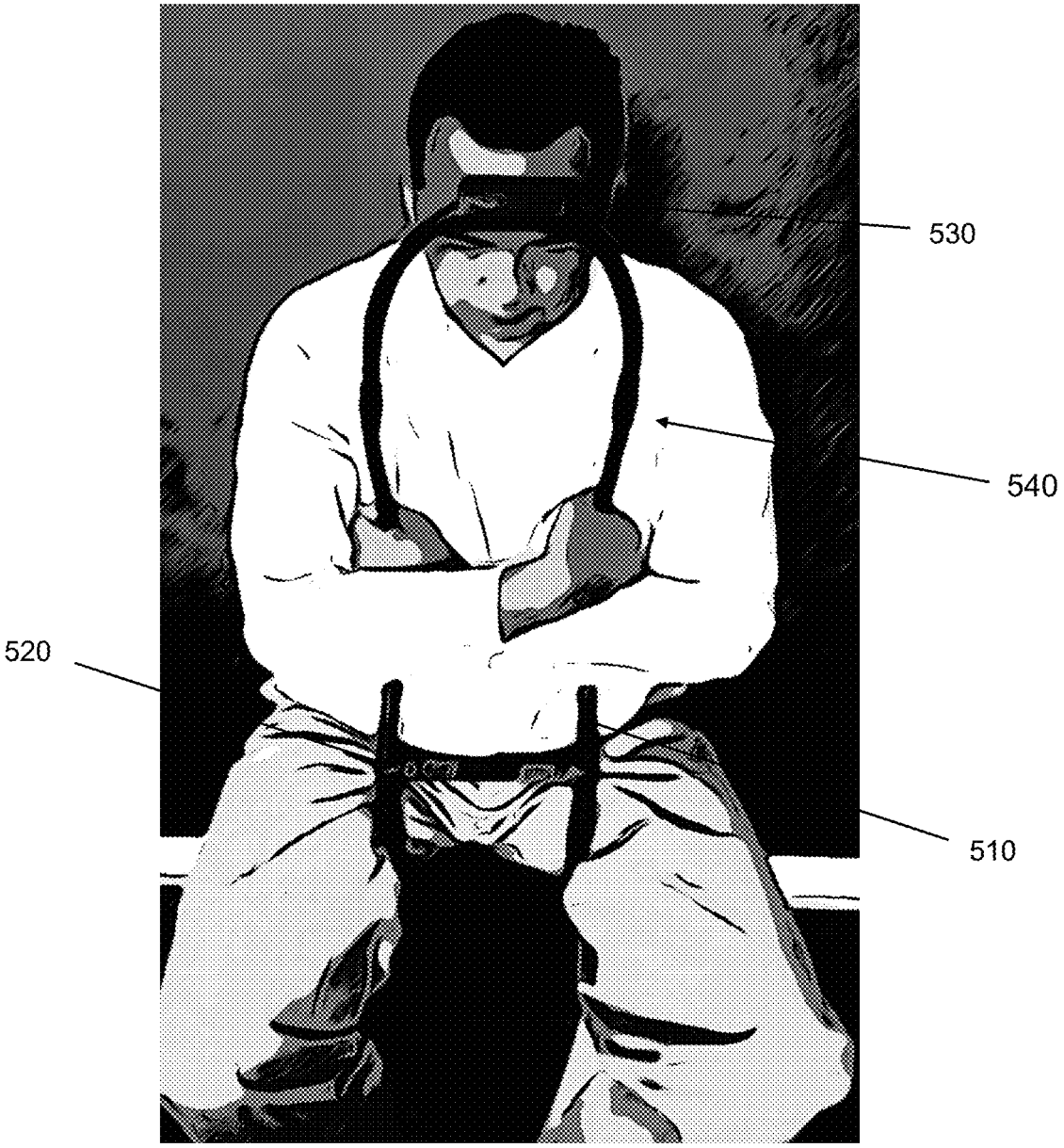
FIG. 5 illustrates a front view of a multipurpose productivity device with one horizontal support bar having a pad disposed around a portion of the device in a nap station configuration in use by a user in accordance with some embodiments of the present invention.

In the nap station configuration, the curved u-shaped portion of the elongate support member 410 may comprise the padded cushion 440 disposed therearound. The horizontal support bars 420 may each be disposed closer to the terminal feet 430 which themselves may be arranged in a splayed manner as illustrated in FIG. 4 for support under the users legs as illustrated in FIG. 5. Generally, the non-curved parallel portions of the elongate support member 410 may be disposed away from the horizontal support bars 420 and the terminal feet 430 in order to define a length that is conducive for the user to rest their head against the padded cushion 440 while sitting down at an office desk chair, a park bench, a passenger seat of a car and the like.

As shown in FIG. 5, a front view of a multipurpose productivity device 500 with one or more horizontal support bars 520 having a pad 530 disposed around a portion of the device in a nap station configuration 540 in use by a user is provided. The multipurpose productivity device 500 may comprise an elongate support member 510, one or more horizontal support bars 520 and a padded cushion 530 surrounding the curved u-shaped portion of the elongate support member 510. While the terminal feet (not shown) are hidden underneath the user's legs, it is understood that all structural elements from the embodiment of FIG. 4 are similarly implemented in the embodiment of FIG. 5.

In use in the nap configuration, the user may place the terminal feet in the splayed configuration under the user's legs and may grip the non-curved parallel portions of the elongate support member 510 with the user's hands, thereby stabilizing the multipurpose productivity device 500 against the user's body. Further, the user may then bring the padded cushion 530 covering the curved u-shaped portion of the elongate support member 510 towards the user's face or forehead while in the seated position, thereby further stabilizing the user's head relative the multipurpose productivity device 500.

In such a configuration, the user is then able to rest their eyes, relax their core muscles and release bodily tension by posturing against the device 500 and/or an adjacent wall. Unlike a wall, however, the padded cushion 530 allows the user a comfortable and sanitary space upon which to rest their head. Further, by sitting down and gripping the elongate support members 510 the user is able to rest and/or sleep in a safe position that will not result in the user tipping over out of the seated position and injuring themselves.

Figure 6:
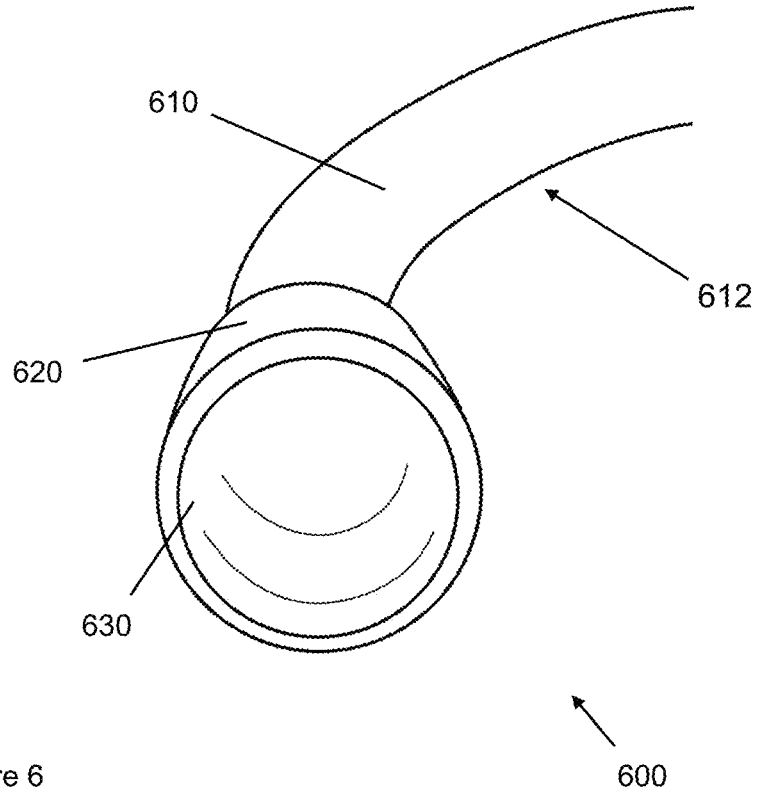
FIG. 6 illustrates a detailed front and interior view of a gooseneck structure and modular coupling mechanism of a multipurpose productivity device in accordance with some embodiments of the present invention.

As shown in FIG. 6, a detailed front and interior view of a gooseneck structure 610 and modular coupling mechanism 620 of a segment 612 of a multipurpose productivity device 600 is provided. The gooseneck structure 610 may be fabricated with the modular coupling mechanism 620 at one or more terminal ends thereof. The modular coupling mechanism 620 may allow an elongate support member of FIGS. 1-5 to modularly and serially couple multiple segments 612 of elongate support member together to form a longer elongate support member as desired by the user.

Specifically, a taller user may desire a longer elongate support member and therefore may want to add additional segments to their existing elongate support member. In such a case, the user may insert a first end of an existing elongate support member into an inner cavity 630 of the gooseneck structure 610 and couple the two together using the modular coupling mechanism 620. This may be accomplished in any suitable manner such as frictional coupling or the like.

The inner cavity 630 of the gooseneck structure segment 610 may comprise the functional material thereof including, but not limited to, the high-strength coiled or spiraled metal as well as the malleable metal dispersed between coils or spirals of the high-strength material. This construction provides both the load-bearing capacity characteristics of the multipurpose productivity device 600 and also the flexible modular nature of its shape.

Figure 7:
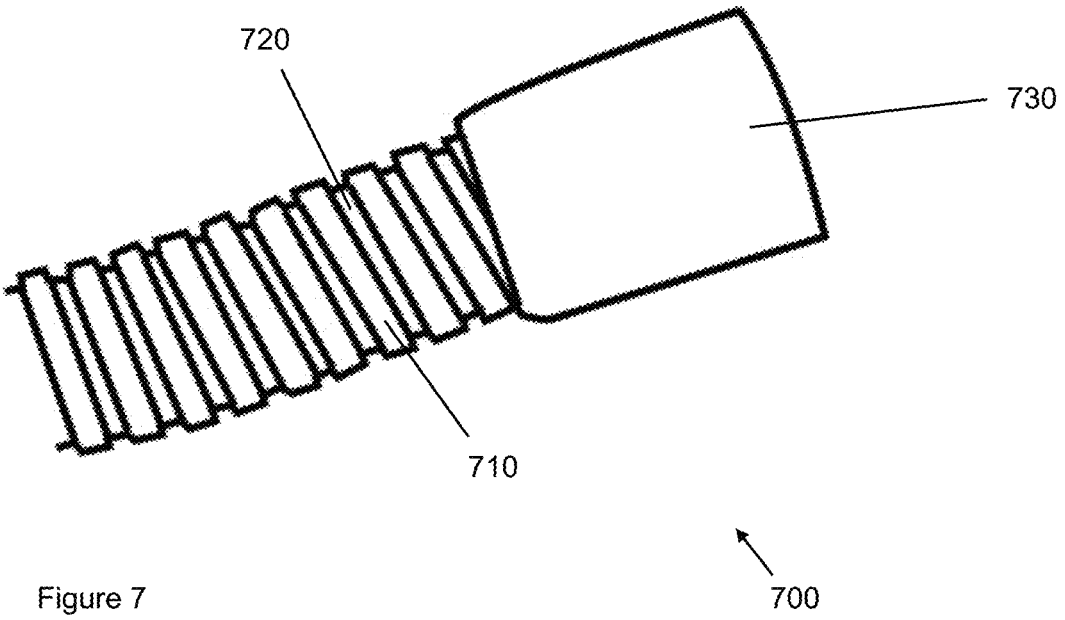
FIG. 7 illustrates a detailed side view of a gooseneck structure and modular coupling mechanism of a multipurpose productivity device in accordance with some embodiments of the present invention.

As shown in FIG. 7, a detailed side view of a gooseneck structure and modular coupling mechanism 730 of a segment of a multipurpose productivity device 700 is provided. The segment of multipurpose productivity device 700 may comprise successively alternating peaks 710 and troughs 720 that may correspond to the coiled or spiraled interior gooseneck construction and high-strength and malleable metals described with reference to FIG. 6. Further, the segment 700 may comprise a modular coupling mechanism 730 akin to that of FIG. 6 which may serve a similar purpose of coupling together successively serial segments of gooseneck structure.

The specification and drawings are to be regarded in an illustrative rather than a restrictive sense. However, it will be evident that various modifications and changes may be made thereunto without departing from the broader spirit and scope of the invention as set forth in the claims. Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a," "an," "the," and similar referents in the context of describing the disclosed embodiments (especially in the context of the following claims) are to be construed to cover both the singular and the plural, unless otherwise indicated or clearly contradicted by context. The terms "comprising," "having," "including," and "containing" are to be construed as open-ended terms (i.e., meaning "including, but not limited to,") unless otherwise noted. The term "connected," where unmodified and referring to physical connections, is to be construed as partly or wholly contained within, attached to, or joined together, even if there is something intervening. Recitation of ranges of values are merely intended to serve as a shorthand method of referring individually to each separate value falling within the range, unless otherwise indicated and each separate value is incorporated into the specification as if it were individually recited. The use of the term "set" (e.g., "a set of items") or "subset" unless otherwise noted or contradicted by context, is to be construed as a nonempty collection comprising one or more members. Further, unless otherwise noted or contradicted by context, the term "subset" of a corresponding set does not necessarily denote a proper subset of the corresponding set, but the subset and the corresponding set may be equal.

Throughout this disclosure, the phrase 'modularly coupled' and similar terms and phrases are intended to convey that any element of a given class of elements may be coupled to another given element and vice versa with equal effect. For example, any extension cord of a plurality of identical extension cords may be modularly coupled to another identical extension cord and vice versa with equal effect. Further, throughout this disclosure, the phrase 'removably coupled' and similar terms and phrases are intended to convey that a given element may be iteratively and operably coupled to and removed from another given element as desired by the user. For example, a male plug of an extension cord may be iteratively coupled to and removed from a female socket of a wall outlet in any manner desired by the user.

Conjunctive language, such as phrases of the form "at least one of A, B, and C," or "at least one of A, B and C," is understood with the context as used in general to present that an item, term, etc., may be either A or B or C, or any nonempty subset of the set of A and B and C, unless specifically stated otherwise or otherwise clearly contradicted by context. For instance, in the illustrative example of a set having three members, the conjunctive phrases "at least one of A, B, and C" and "at least one of A, B and C" refer to any of the following sets: {A}, {B}, {C}, {A, B}, {A, C}, {B, C}, {A, B, C}. Thus, such conjunctive language is not generally intended to imply that certain embodiments require at least one of A, at least one of B and at least one of C each to be present. In addition, unless otherwise noted or contradicted by context, the term "plurality" indicates a state of being plural (e.g., "a plurality of items" indicates multiple items). The number of items in a plurality is at least two, but can be more when so indicated either explicitly or by context.

The use of any examples, or exemplary language (e.g., "such as") provided, is intended merely to better illuminate embodiments of the invention and does not pose a limitation on the scope of the invention unless otherwise claimed. No language in the specification should be construed as indicating any non-claimed element as essential to the practice of the invention.

Embodiments of this disclosure are described, including the best mode known to the inventors for carrying out the invention. Variations of those embodiments may become apparent to those of ordinary skill in the art upon reading the foregoing description. The inventors expect skilled artisans to employ such variations as appropriate and the inventors intend for embodiments of the present disclosure to be practiced otherwise than as specifically described. Accordingly, the scope of the present disclosure includes all modifications and equivalents of the subject matter recited in the claims appended hereto as permitted by applicable law. Moreover, although above-described elements may be described in the context of certain embodiments of the specification, unless stated otherwise or otherwise clear from context, these elements are not mutually exclusive to only those embodiments in which they are described; any combination of the above-described elements in all possible variations thereof is encompassed by the scope of the present disclosure unless otherwise indicated or otherwise clearly contradicted by context.

All references, including publications, patent applications, and patents, cited are hereby incorporated by reference to the same extent as if each reference were individually and specifically indicated to be incorporated by reference and were set forth in its entirety.

The invention claimed is:

1. A multipurpose productivity device, comprising:
- an elongate support member having a high-curvature portion and a low-curvature portion, wherein:
  - the low-curvature portion comprises two substantially parallel segments, and
  - the elongate support member comprises gooseneck material;
- one or more horizontal support bars coupling together the two substantially parallel segments; and
- a plurality of terminal feet disposed at terminal ends of the elongate support member.

2. The multipurpose productivity device of claim 1, wherein the gooseneck material comprises a high-strength rigid metal material and a low-strength malleable metal material.

3. The multipurpose productivity device of claim 2, wherein the low-strength malleable metal material is disposed between, within or around the high-strength rigid metal material.

4. The multipurpose productivity device of claim 1, wherein the gooseneck material comprises a spiral structure.

5. The multipurpose productivity device of claim 1, wherein an exterior of the gooseneck material comprises a plurality of successive peaks and troughs along the length thereof.

6. The multipurpose productivity device of claim 1, wherein the high-curvature portion comprises at least a 180 degree path angle.

7. The multipurpose productivity device of claim 1, wherein the low-curvature portion comprises no more than a 30 degree path angle.

8. The multipurpose productivity device of claim 1, wherein the one or more horizontal support bars comprise gooseneck material.

9. The multipurpose productivity device of claim 1, wherein the one or more horizontal support bars comprise a high-strength rigid material.

10. The multipurpose productivity device of claim 1, wherein the one or more horizontal support bars are coupled to the two substantially parallel segments via one or more tension grips.

11. The multipurpose productivity device of claim 10, wherein the one or more horizontal support bars are modularly and removably coupled to the two substantially parallel segments.

12. The multipurpose productivity device of claim 1, wherein the plurality of terminal feet comprise a protective cap disposed thereover.

13. The multipurpose productivity device of claim 12, wherein the protective cap comprises foam, rubber, plastic, heat shrink wrap or any combination thereof.

14. The multipurpose productivity device of claim 1, wherein the elongate support member comprises a plurality of modular segments.

15. The multipurpose productivity device of claim 14, wherein the plurality of modular segments are modularly, removably and serially coupled together.

16. The multipurpose productivity device of claim 1, wherein the elongate support member comprises a chair configuration, a nap station configuration and a lap desk configuration.

17. The multipurpose productivity device of claim 1, wherein the elongate support member comprises a load-bearing capacity of between 5 pounds and 20 pounds.

18. A multipurpose productivity device, comprising:
- an elongate support member having a high-curvature portion and a low-curvature portion, wherein:
  - the low-curvature portion comprises two substantially parallel segments,
  - the elongate support member comprises a plurality of modular segments, and
  - the elongate support member comprises gooseneck material;
- one or more horizontal support bars coupling together the two substantially parallel segments, wherein:
  - the one or more horizontal support bars comprise a high-strength rigid material; and
- a plurality of terminal feet disposed at terminal ends of the elongate support member.

19. A multipurpose productivity device, comprising:
- an elongate support member having a high-curvature portion and a low-curvature portion, wherein:
  - the high-curvature portion comprises at least a 180 degree path angle,
  - the low-curvature portion comprises two substantially parallel segments,
  - the elongate support member comprises a plurality of modular segments, and
  - the elongate support member comprises gooseneck material comprising a high-strength rigid metal material and a low-strength malleable metal material;
- one or more horizontal support bars coupling together the two substantially parallel segments, wherein:

the one or more horizontal support bars comprise a high-strength rigid material; and a plurality of terminal feet disposed at terminal ends of the elongate support member.

* * * * *